US007455028B2

(12) United States Patent
Baker

(10) Patent No.: US 7,455,028 B2
(45) **Date of Patent: *Nov. 25, 2008**

(54) PORTABLE AND STOWABLE SAFETY DEVICE

(76) Inventor: Stephen J. Baker, 4100 Harbor Rd., Orange Beach, AL (US) 36561

( * ) Notice: Subject to any disclaimer, the term of this patent is extended or adjusted under 35 U.S.C. 154(b) by 246 days.

This patent is subject to a terminal disclaimer.

(21) Appl. No.: 11/288,044

(22) Filed: Nov. 28, 2005

(65) Prior Publication Data

US 2007/0240626 A1 Oct. 18, 2007

Related U.S. Application Data

(63) Continuation-in-part of application No. 10/945,309, filed on Sep. 20, 2004, now Pat. No. 6,968,801, which is a continuation-in-part of application No. 10/684,848, filed on Oct. 14, 2003, now Pat. No. 6,792,887.

(51) Int. Cl.
*B63B 17/00* (2006.01)
*E06C 1/52* (2006.01)

(52) U.S. Cl. ..... 114/362; 182/196

(58) Field of Classification Search ..... 114/362
See application file for complete search history.

(56) References Cited

U.S. PATENT DOCUMENTS

| | | | | |
|---|---|---|---|---|
| 2,651,789 | A | 9/1953 | Newland | |
| 2,975,858 | A | 3/1961 | Billingsley | |
| 4,926,965 | A | 5/1990 | Fox | |
| 4,986,785 | A | 1/1991 | Flowers | |
| 5,074,236 | A | 12/1991 | Robertson | |
| 5,540,178 | A | 7/1996 | Damron | |
| 5,542,369 | A | 8/1996 | Ingram | |
| 5,704,447 | A | 1/1998 | Doyle | |
| 5,848,667 | A | 12/1998 | Davidson | |
| 6,343,562 | B1 | 2/2002 | Ingram | |
| 6,464,038 | B1 | 10/2002 | Park | |
| 6,533,626 | B2 | 3/2003 | Pons | |
| 6,968,801 | B2 * | 11/2005 | Baker | 114/362 |
| 2002/0119715 | A1 | 8/2002 | Pons | |

* cited by examiner

*Primary Examiner*—Jesús D Sotelo
(74) *Attorney, Agent, or Firm*—Bradley Arant Rose & White

(57) ABSTRACT

A safety device including a support that may be stowed within an enclosure and easily extended for use. One embodiment comprises an adjustable length strap coupled to a support strap fixed in the form of a loop that may act as a handle or a step, and a keeper comprising a pouch closable by a flap to form an enclosure. Multiple support loops may be attached to one another as desired. The upper end of the adjustable length strap is coupled to the interior of the keeper, and the keeper may be attached to a vessel or other object via a securing loop on its rear side. The straps are gathered inside the keeper, with a portion of the lowermost support loop hanging outside the keeper and fixed in position by the closed flap, such that the exposed support loop when pulled will cause the flap to open and the strap to extend.

9 Claims, 2 Drawing Sheets

FIG. 1
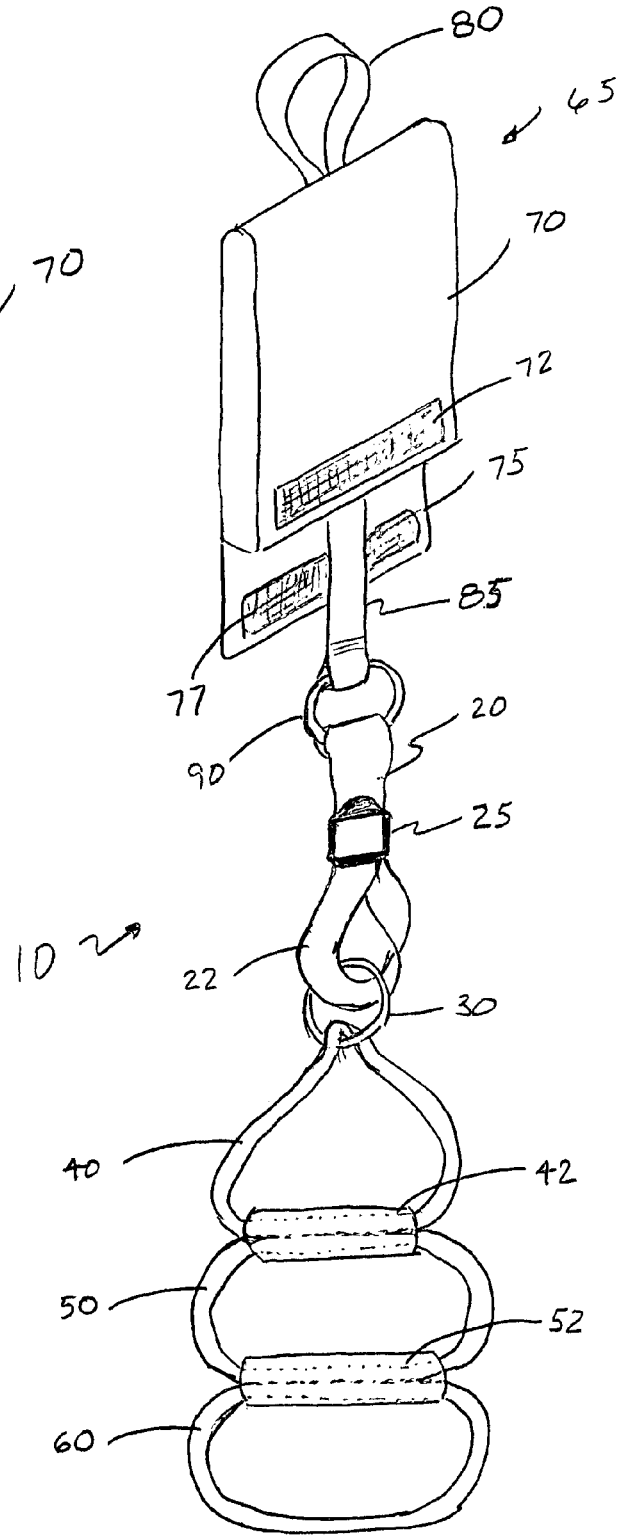
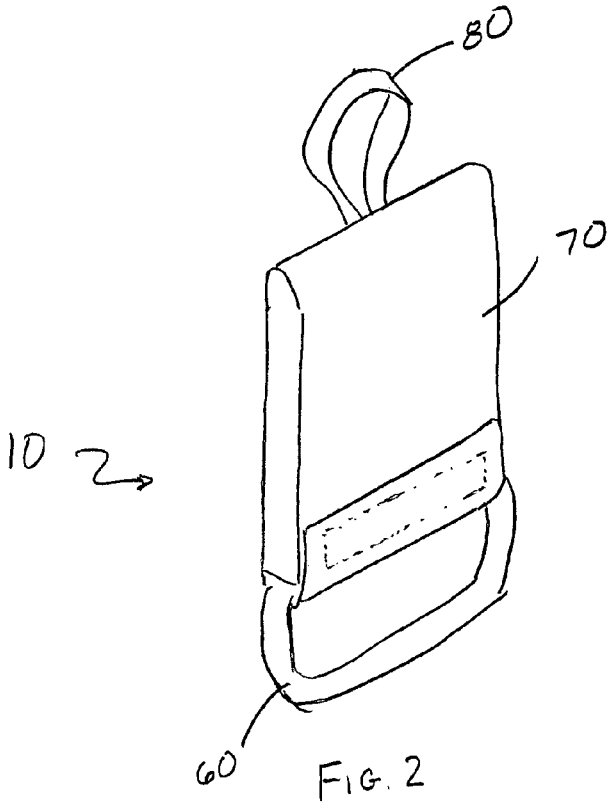
FIG. 2

PORTABLE AND STOWABLE SAFETY DEVICE

PRIORITY CLAIM

This application is a continuation-in-part and claims priority to and the benefit of patent application Ser. No. 10/945,309, filed Sep. 20, 2004 now U.S. Pat. No. 6,968,801, which is a continuation-in-part of Ser. No. 10/684,848, filed Oct. 14, 2003 now U.S. Pat. No. 6,792,887.

BACKGROUND

The present invention provides a lightweight, stowable and extendable support, or supports, to allow easy entry into a vessel by a person in the water, and for a variety of other uses. The invention is discussed and illustrated with respect to kayaks, but it may be used with virtually any water-borne vessel to which it may be secured.

Persons involved in sea kayaking, canoeing, sailing, or other boating activities may fall into the water, either intentionally or unintentionally. Depending on the conditions, such as current, wave level, water temperature, weather, and the like, it may be difficult to re-enter the vessel, and for some people with physical restrains or handicaps, or wearing heavy clothing or shoes, re-entry under any conditions may be difficult. Difficulty in re-entering a vessel from the water poses a safety issue and discourages some people from participating in these activities altogether.

A simple device to allow re-entry of a vessel from the water is needed. The device should satisfy various requirements of the marine environment and of the particular application in which it is used. For example, it must be durable and capable of withstanding water and sun. It should be stowable and secure, so that it does not interfere with other activities or objects on the vessel, such as paddling or lines and ropes on and extending from the vessel (e.g., ski ropes, anchor lines, fishing lines, etc.). It ought to be adjustable in length and attach to a variety of vessels, and it would also be advantageous if the device were lightweight, relatively inexpensive, and easy to use. In addition, it would be advantageous for the device to accommodate multiple straps and handles. It also would be helpful if the device were capable of attachment to personal flotation devices or any other sort of safety harness.

The embodiments of the present invention, as described and claimed herein, satisfy these needs and provide a stowable and extendable support that may be attached to virtually any vessel and which allows easy re-entry from the water into the vessel, as well as attachment to personal flotation devices, and may be used for a variety of other uses. The device thus increases safety and encourages participation in and the enjoyment of boating activities.

SUMMARY

One embodiment of the present invention is a stowable, adjustable length safety device including a primary strap and at least one support strap, stored within a keeper for immediate deployment. The upper end of the support strap is coupled to the interior of the keeper (either directly or through an intermediate strap and ring combination), and the lower end of the primary strap passes through a ring and doubles back through an adjustment clip to form a loop of adjustable size. A first support strap comprising a fixed loop likewise passes through the ring, thus coupling the first support strap to the primary strap. The keeper stows or houses the remaining components when they are not in use. The keeper includes a pouch with an interior surface and an exterior surface having at its lower end an opening and a flap foldable over the opening. The flap and the exterior surface of the pouch adjacent to the opening have releasable fasteners such as Velcro® so that the flap can be secured in place. The keeper also includes a securing loop fixed to the back side of the pouch for securing the device to a person or object. Additional support straps may be included below the first support strap. Such secondary and tertiary support straps are in the form of fixed loops. A tubular grip may be placed on each support strap to aid in ease of use. The pouch is large enough to stow the various straps inside. A portion of the lowermost support loop is left hanging from the opening in the pouch and is fixed in that position when the flap is closed. When a user pulls on the exposed portion of the support loop, the flap releases and the straps and support loops extend from the keeper.

DESCRIPTION OF DRAWINGS

These and other features, aspects, structures, advantages, and functions are shown or inherent in, and will become better understood with regard to, the following description and accompanied drawings where:

FIG. 1 is a perspective view of one embodiment of the present invention, with the strap extended and the keeper in an open configuration;

FIG. 2 is the embodiment of FIG. 1 with the strap and the keeper in a closed, stowed configuration;

DETAILED DESCRIPTION

Figure 3:
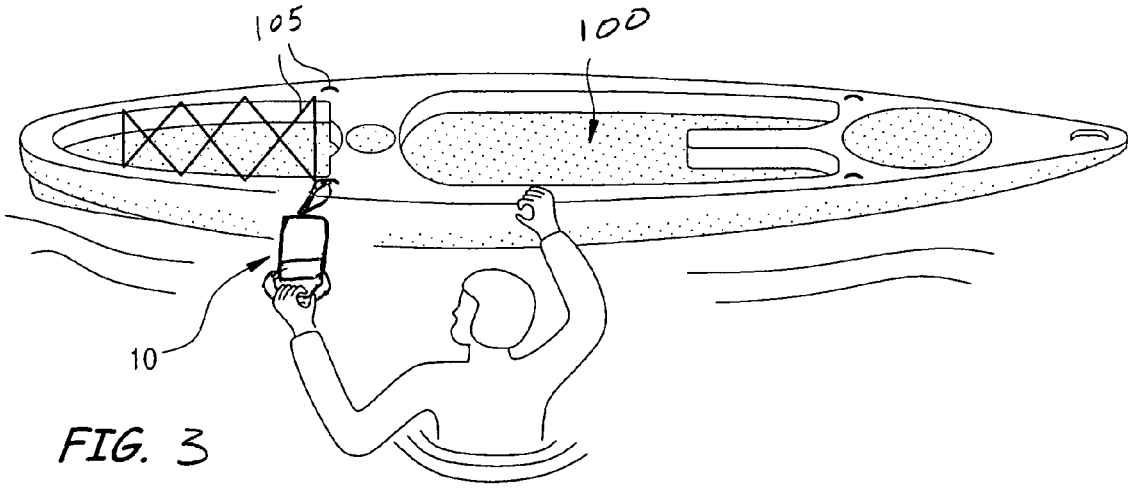
FIG. 3 is a perspective view of an embodiment of the present invention, in its closed, retracted configuration, attached to a kayak, with a kayaker in position to grab the support.

As shown in FIG. 1, one embodiment of the safety device 10 of the present invention comprises a primary strap 20, a ring 30, a first support strap 40, and optionally secondary and tertiary support straps 50 and 60, respectively. In addition, the device 10 comprises a keeper 65 for storage of the foregoing components.

The primary strap 20 is threaded through an adjustment clip 25, through which the lower end of the primary strap 20 is doubled back to form a loop 22. This loop 22 passes freely through the ring 30. Thus, the length of the primary strap 20 may be readily adjusted by increasing or decreasing the size of the loop 22 via adjustment clip 25. The upper end of the primary strap 20 is coupled to the interior of the keeper 65. The primary strap may be sewn onto or otherwise directly attached to the keeper, or it may be coupled via an intermediate strap 85 and second ring 90, as shown in FIG. 1. In such a configuration, the upper end of the intermediate strap 85 is fixed to the keeper.

The first support strap 40 comprises a strap configured in a loop of fixed length, which is passed through the ring 30, thus coupling the first support strap 40 to the primary strap 20. Additional support straps may be attached to the first support strap 40 to add length or additional supports as needed for a particular application. As shown in FIG. 1, a secondary support strap 50 configured as a loop of fixed length is attached to the first support strap 40, and a tertiary support strap 60 configured as a loop of fixed length is attached to the secondary support strap 50. The loop structure utilized in each support strap may be achieved simply by overlapping and fixing into position the ends of a single strap, such as by sewing, ultrasonic welding, or any other method of attachment known in the art. The support straps may act as handles or steps. The straps 20, 40, 50, and 60 may be constructed of any suitably strong and durable material, capable of maintaining its strength and longevity in a wet environment. Commonly available nylon webbing is adequate.

In a typical embodiment, the support straps will include tubular grips 42 and 52 as shown in FIG. 1. The support straps may simply be passed through these grips before they are fixed into a loop configuration. The tubular grips may be constructed of any desired material, such as a plastic, polymer, foam, or rubber-type material. A foam or polymer grip may be used to improve ergonomics and reduce slippage in the water, or be designed such that the grip floats. In other applications, it may be desirable to construct the grips from metal, such as aluminum or stainless steel. The grips may be designed to be removable. In an embodiment using grips of sufficient strength, the support straps may be passed through the grips as described but without fixing the successive support straps to one another; that is, such an embodiment relies upon the grip to join the support straps in succession, rather than fixing the straps to one another directly.

The keeper 65 serves to stow the remainder of the components for immediate deployment when they are not in use. The keeper 65 comprises a pouch 70 with an opening at is bottom, a flap 75 that may be folded over the opening, and a securing loop 80 affixed to the rear of the pouch 70. The flap 75 includes a releasable fastener such as Velcro® affixed to its inside surface 77, and the pouch 70 includes the complementary portion of the releasable fastener on its front side 72 just above the opening as shown, such the flap may be releasably secured over the opening. The securing loop 80 on the back of the keeper allows the keeper to be attached quickly and easily to a variety of objects, such as a cleat on a vessel, a strap or loop on a personal flotation device, a safety harness or virtually any object to which the user desires the safety device to be attached.

The keeper 65 may be constructed of any material suited for the intended application, such as durable nylon fabric or heavy-duty vinyl. It could be constructed of a mesh material. The keeper 65 may be of any suitable shape, polygonal, circular, or irregular, depending on the needs and preferences of a user or a particular application. Like all other components of the device, the keeper 65 may be of any desirable color and may include reflective highlights. Further, the keeper may be constructed to comprise some amount of hydrophobic foam or low density material such that it floats.

In operation, the primary strap 20, the ring 30, and support straps 40, 50, and 60 are gathered within the keeper 65 with a portion of the lowermost support strap extending outside. (That is, if a particular embodiment had only the first support strap, then a portion of the first strap would be exposed outside the keeper; if a particular embodiment had a secondary or tertiary strap, then a portion of the last, or lowermost, support strap would be exposed). The flap 75 is brought through the loop of the lowermost support strap and secured to the front of the pouch 70. The closure of the flap 75 in this way thus fixes a portion of the loop of lowermost support strap in position hanging outside the keeper (i.e., the exposed loop). When a user pulls on the exposed loop, the flap 75 opens and the straps extend.

Figure 4:
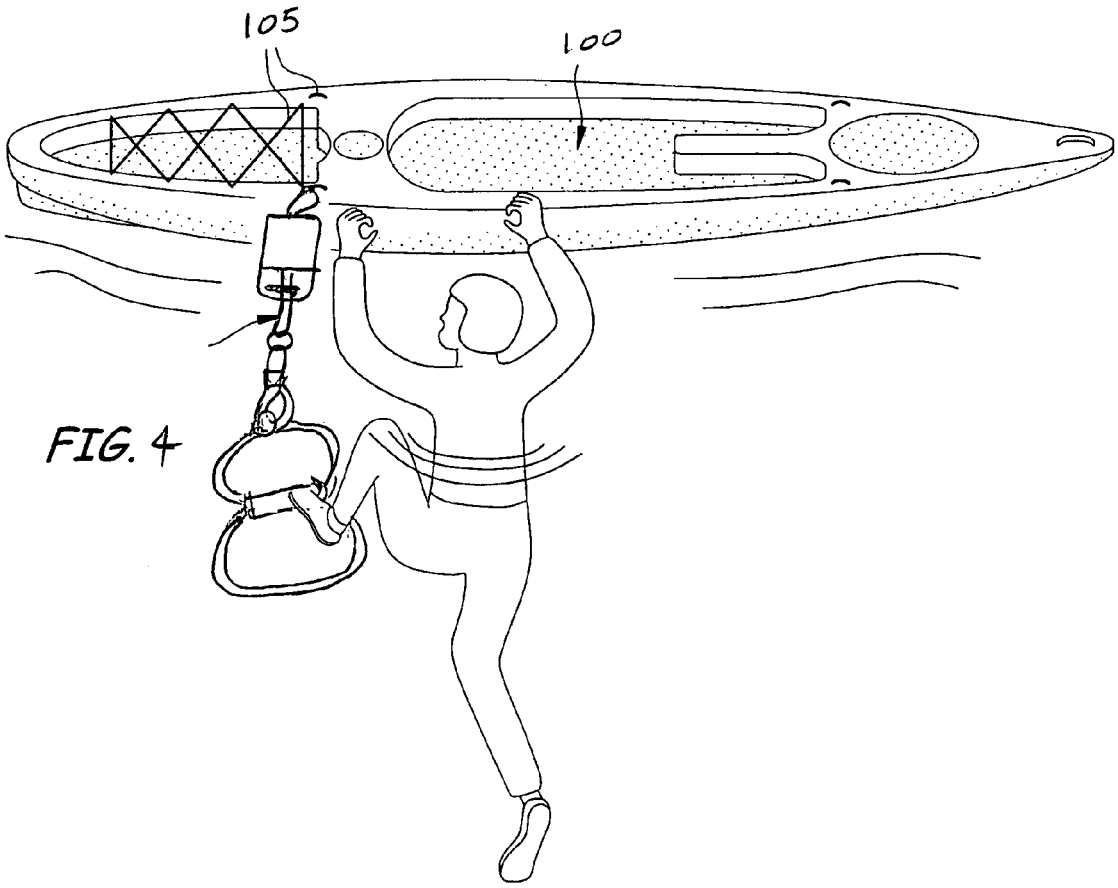
FIG. 4 is a perspective view of the embodiment shown in FIG. 3, in its open, extended configuration, with the kayaker having put his foot in place on a support and preparing to board the vessel.

The device is shown in use in FIGS. 3-4. FIG. 3 illustrates the safety device 10, in a closed configuration, attached to a vessel 100 (shown as a sea kayak) via an eye 105 with a user in the water in position to use the step to re-enter the vessel. The user grasps and pulls on the exposed loop 60, causing the straps to extend. Then as shown in FIG. 4, the user guides a support strap to his foot, grabs onto the vessel, and is in position and able to lift himself into the boat. As the person bears his weight on and pushes against the support strap, the vessel rolls laterally towards the person and thus allows the user to easily enter the vessel.

The portable, stowable safety device thus described and illustrated provides an easy-to-use, readily accessible way for almost any person to enter a vessel, such as a kayak, from the water. In addition, an overboard person can simply hold onto the support to prevent being separated from the vessel. The device may be secured to a personal flotation device to allow a rescuer to have a ready and easy hand-hold on a person in the water. This device thus makes boating safer and more enjoyable for individuals, especially those with disabilities, who would otherwise be unable to regain entry into the vessel from the water. Further, the device is lightweight and portable, and thus may easily be moved from one vessel to another, or from one personal flotation device to another. It may be used on virtually any type of watercraft, including kayaks, ocean kayaks, canoes, ski boats, fishing boats, sailboats, party or pontoon boats, life boats, white-water rafts and other rafts, and any other vessel or object to which the safety device may be secured.

The uses of the device as claimed should not be restricted to water or marine-based uses. For example, the device could be configured for use as a stowable fire escape ladder for residential use, or as a ladder for hunters to use in accessing deer stands.

Although the present invention has been described and shown in considerable detail with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

I claim:

1. A safety device comprising:

a primary strap, with an upper end and a lower end, having an adjustment clip thereon through which the lower end of said strap is passed to form a loop of adjustable size;

a ring, the loop of said primary strap passing through said ring;

a first support strap comprising a fixed loop passing through said ring; and a keeper comprising:

a pouch with an interior surface and an exterior surface, said pouch having at its lower end an opening and a flap foldable over said opening and releasably securable to the exterior surface of said pouch opposite from the flap; and a securing loop fixed to the back side of said pouch for securing said device to a person or object; and wherein the upper end of said primary strap is coupled to the interior of said pouch, the pouch being of sufficient size to stow said straps inside with at least a portion of one of said straps hanging from said opening in a position fixed by the closure of said flap.

2. The device of claim 1, further comprising a secondary support strap comprising a fixed loop, said secondary support strap attached to said first support strap.

3. The device of claim 2, further comprising a tertiary support strap comprising a fixed loop, said tertiary support strap attached to said secondary support strap.

4. The device of claim 1, further comprising a first tubular grip, the loop of said first support strap passing through said tubular grip.

5. The device of claim 4, further comprising a secondary support strap comprising a fixed loop, the loop of said secondary support strap passing through said first tubular grip.

6. The device of claim 5, wherein said secondary support strap is attached to said first support strap along the portion of said straps bounded by said first tubular grip.

7. The device of claim 5, further comprising a second tubular grip and tertiary support strap comprising a fixed loop, the loop of said tertiary support strap passing through said second tubular grip.

8. The device of claim 6, further comprising a second tubular grip and tertiary support strap comprising a fixed loop, the loop of said tertiary support strap passing through said second tubular grip and attached to the loop of said second support strap along the portion of said second and tertiary straps bounded by said second tubular grip.

9. The device of claim 1, further comprising an intermediate strap and a second ring, one end of said intermediate strap fixed to the interior of said pouch, and the other end of said intermediate strap fixed to said second ring, and wherein the upper end of said primary strap is fixed to said second ring, such that said primary strap is coupled to said pouch via said intermediate strap and second ring.

* * * * *